United States Patent [19]

Aizawa

[11] 4,376,992

[45] Mar. 15, 1983

[54] ELECTRONIC WRISTWATCH WITH ALARM FUNCTION

[75] Inventor: Hitomi Aizawa, Suwa, Japan

[73] Assignee: Kabushiki Kaisha Suwa Seikosha, Tokyo, Japan

[21] Appl. No.: 125,304

[22] Filed: Feb. 27, 1980

[30] Foreign Application Priority Data

Feb. 28, 1979 [JP] Japan ..... 54-23911

[51] Int. Cl.[3] ..... G04C 11/02; G04F 5/00; G04C 21/16

[52] U.S. Cl. ..... 368/47; 368/156; 368/250

[58] Field of Search ..... 368/12, 46, 47, 51, 368/52, 72–74, 76, 80, 155–160, 243, 250, 251, 255; 73/6

[56] References Cited

U.S. PATENT DOCUMENTS

| | | | |
|---|---|---|---|
| 3,940,919 | 3/1976 | Yasuda et al. | 368/255 |
| 3,946,591 | 3/1976 | Yanagawa et al. | 73/6 |
| 3,998,044 | 12/1976 | Yamauchi et al. | 368/80 |
| 4,104,865 | 8/1978 | Sasaki | 368/251 |
| 4,144,706 | 3/1979 | Willis | 368/159 |
| 4,216,647 | 8/1980 | Hattori | 368/245 |

*Primary Examiner*—Vit W. Miska

*Attorney, Agent, or Firm*—Blum, Kaplan, Friedman, Silberman & Beran

[57] ABSTRACT

An electronic wristwatch without mechanically driven hands has an electromagnetic output which is sensed for measuring the timing rate. A modulated signal applied to the coil of an alarm sounding device produces the electromagnetic field for sensing. The display is fully illuminated while timing in order to eliminate stray electric fields.

10 Claims, 2 Drawing Figures

ELECTRONIC WRISTWATCH WITH ALARM FUNCTION

BACKGROUND OF THE INVENTION

This invention relates generally to an electronic wristwatch of the type having no mechanically driven hands and more particularly to an electronic wristwatch of this type which outputs electromagnetic signals suitable to measure the timing rate. In the prior art, as an apparatus for measuring the timing rate, there is a device which measures the vibrational rate of a quartz crystal vibrator, which is the time standard source of a wristwatch, by means of a sound detector. The timing rate is the gain or loss in timekeeping of a wristwatch in a day. In an electronic timepiece having hands for indicating time, the timing rate is determined by measuring the magnetic field of the driving motor for the hands by means of an electromagnetic field detector. In a digital display electronic timepiece having a liquid crystal display device, the timing rate is measured by means of an electric field detector based on a 32 Hertz signal used in the AC drive on the display. Especially with a liquid display electronic timepiece, there is no apparatus for measuring the timing rate excepting instruments using an magnetic field detector or a sound detector. In recent years, a device using the above mentioned electromagnetic field detector has been popularized, and as a liquid crystal display electronic timepiece is now widely in use, it is most desirable, if not necessary to measure the timing rate by means of an electric field detector or a sound detector. Therefore, the timing rate is now measured by means of a conventional timing rate measuring device through an adapter making it necessary for the watchmaker to purchase the adapter. Moreover, as compared with an instrument using an electromagnetic field detector, the instrument using an electric field detector or an sound detector is easily influenced by external fields, noises, or the like, and accordingly measurement becomes difficult.

What is needed is an electronic wristwatch without mechanically driven hands which can be readily timed using conventional timing instruments which operate on electromagnetic fields.

SUMMARY OF THE INVENTION

Generally speaking, in accordance with the invention, an electronic wristwatch especially suitable for providing timing rate signals is provided. An electronic wristwatch without mechanically driven hands has an electromagnetic output which is sensed for measuring the timing rate. A modulated signal applied to the coil of an alarm sounding device produces an electromagnetic field used for sensing of timing rate. The display is fully illuminated while timing in order to eliminate stray electric fields. The modulated signal is produced upon closure of switches operated by means of an external member. The wristwatch in accordance with this invention eliminates the above-mentioned difficulties and provides a means by which the timing rate of a liquid crystal display electronic wristwatch is easily measured by using a conventional electromagnetic field detector.

In the field of digital display electronic wristwatches, products having an alarm function are now very popular. In such a wristwatch, if a current is applied to a coil of an alarm device, such as a loud speaker and the current has a period by which the timing rate can be measured, the required measuring apparatus is substantially the same as the apparatus for detecting the electromagnetic field of the driving motor when measuring the timing rate of an electronic timepiece having hands for time indication. With the alarm function present, the electronic magnetic field associated with the sounding device replaces the electromagnetic field of the driving motor used for hands.

Accordingly, it is an object of this invention to provide an improved electronic wristwatch with alarm function which can be timed using conventional electromagnetic field detectors.

Another object of this invention is to provide an improved electronic wristwatch with an alarm function which provides a distinctively modulated signal for use in timing.

A further object of this invention is to provide an improved electronic wristwatch with alarm which provides timing signals upon actuation of an external member.

Still another object of this invention is to provide an improved electronic wristwatch which illuminates the entire liquid display during timing so that stray electric fields are eliminated.

Still other objects and advantages of this invention will in part be obvious and will in part be apparent from the specification.

The invention accordingly comprises the features of construction, combination of elements, an arrangement of parts which will be exemplified in the construction hereinafter set forth, and the scope of the invention will be indicated in the claims.

BRIEF DESCRIPTION OF THE DRAWINGS

For a fuller understanding of the invention, references is had to the following description taken in connection with the accompanying drawings, in which.

DESCRIPTION OF THE PREFERRED EMBODIMENTS

Figure 1:
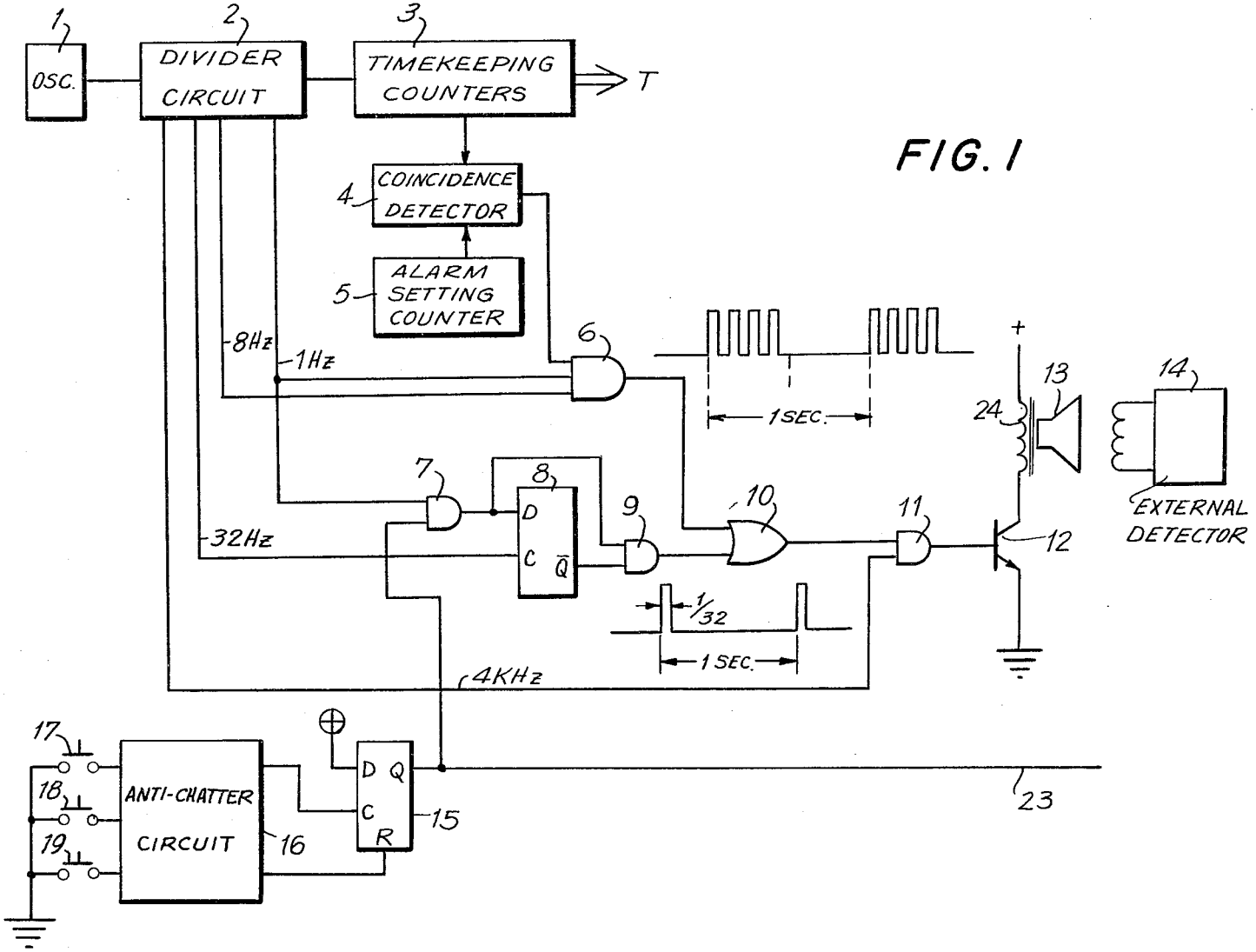
FIG. 1 is a circuit drawing of an electronic wristwatch with alarm function in accordance with this invention.
Figure 2:
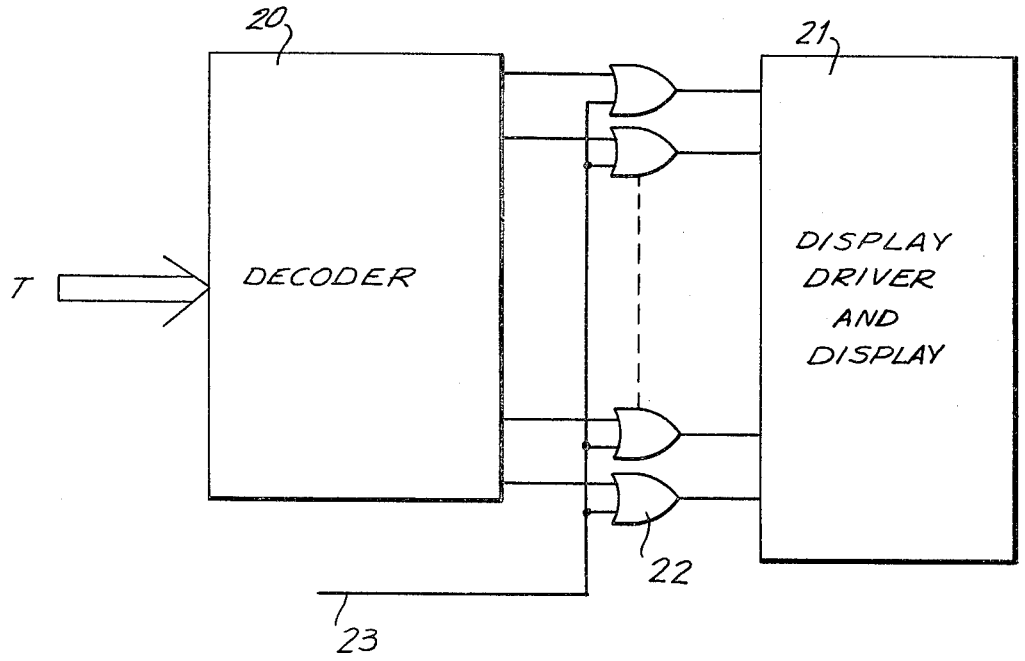
FIG. 2 is a circuit portion used in conjunction with a circuit of FIG. 1 to provide concurrent illumination of all segments of display.

The electronic wristwatch in accordance with this invention is described in detail with reference to the drawings as follows: FIG. 1 shows an exemplary circuit diagram in accordance with this invention. A timepiece includes an oscillator circuit 1, a divider circuit 2 for dividing down the signal applied from the oscillator circuit 1, a counter circuit 3 for counting timekeeping signals from the divider 2, an alarm setting counter 5, which stores data representative of the time at which the alarm should be sounded, a coincidence circuit 4, which determines whether or not the contents of the counter circuit 3 coincides with the contents of the alarm setting counter 5, and a circuit 16 for receiving the chattering inputs of switches 17, 18, 19 and for forming smoothed-out control signals for the timepiece. Further elements of the timepiece are shown in FIG. 2 and are discussed more fully hereinafter. The switches 17, 18, 19 cooperate with an external member or members which are manipulated to operate the switches. In FIG. 1, signals and circuits which are necessary to control the timekeeping and supplemental function of the wristwatch in accordance with this invention are omitted and not described in detail here except those signal and circuits particularly related to this invention. All of the circuit portions which are not described in detail here are conventional.

AND gate 6 comprises a first modulation signal producing circuit. The modulation signal is produced using a 1 Hz signal and a 8 Hz signal from the divider circuit 2. When the logical level of the output signal from the coincidence detector is high, the AND gate 6 outputs a signal which is a combination of the 1 and 8 Hz signals. This output signal is input to an AND gate 11 through an OR gate 10 and is modulated to be a 4 kilohertz signal by the AND gate 11. Thus, the alarm sound which is intermittenly emitted at an 8 Hz repetition rate every one second with a high pitched tone of 4 kilohertz is produced at the output of AND gate 11.

A D-type flip-flop 8 and AND gate 9 comprise a second modulation producing circuit. A control circuit which controls the second modulation signal producing circuit includes a D-type flip-flop 15 and AND gate 7. When switches 17, and 18 are closed at the same time by the operation of an external member (not shown), a clock signal is input at the C terminal of the D-type flip-flop 15, and the logical level at the output Q of the flip-flop 15 becomes high. As a result, blockage of the AND gate 7 is released, and the 1 Hz signal, output of the divider 2, that is the other input to the AND gate 7, is outputted from the AND gate 7. The 1 Hz output of the gate 7 then is applied to the data input D of a D-type flip-flop 8. A 32 Hz output signal from the divider circuit 2 is applied as the clocking input C to the D-type flip-flop 8. A reverse of the 1 Hz signal which is applied to the data input D is output at the $\overline{Q}$ terminal of the D-type flip-flop 8 with a 1/32 second delay. When the 1 Hz signal of the data input D and the output $\overline{Q}$ of the flip-flop 8 are applied to an AND gate 9, the second modulation signal is obtained. This signal has a 1/32 of a second pulse width with a period of 1 second. This second modulation signal and the first modulation signal produced in the AND gate 6 are applied as inputs to an OR gate 10, and the output of the gate 10 is applied as one input to an AND gate 11. The four kilohertz output of the divider circuit 2 is applied to the other input to the AND gate 11 to provide a driving signal at the output of the AND gate 11.

This driving signal is applied to the base electrode of a npn-type transistor 12, and the transistor 12 is switched on and off by the 4 kilohertz signal, whereby a sound generating device 13 is driven and emits a sound.

When an electromagnetic field detector in a timing rate measuring device 14 is used while the transistor 12 is being switched on and off, a signal can be picked up by electromagnetic induction between the electromagnetic field detector 14 and the coil 24 used in the sound generating device 13. Thus, the timing rate can be easily measured. The pulse width of the second modulation signal may have an arbitrary value. However, if the pulse width is wider than necessary for detection, power consumption is increased and a malfunction may be caused by the voltage drop during generation of the second modulation signal. A pulse width of less than 1/16 seconds is found to be suitable. Moreover, the period of the second modulation signal is also arbitrary, but a period less than 10 seconds is preferred so as to shorten the time used in measuring the timing rate.

When it is not necessary to measure the timing rate, the switch 19 is pushed by operation of an external member. By doing so, a signal is supplied to the reset terminal R of the D-type flip-flop 15 by way of the circuit 16 for preventing and controlling chattering. When the reset signal is applied, the logical level of the output Q of the flip-flop 15 becomes low. As a result, the 1 Hz signal of the divider output is blocked by the AND gate 7, so that the second modulation signal is not produced.

As described above, a signal necessary for measurement of the timing rate is easily produced. Because a conventional timing rate device can detect a 10 second signal or a one second signal to measure the timing rate, the timing rate of this wristwatch is easily measured by a conventional timing rate measuring device using an electromagnetic field detector. This is possible if the alarm, which is the sound generating device is driven by the second modulating signal described above. Accordingly, when checking performance of an electronic wristwatch without a driving motor, an adaptor, or similar device need not be installed on a timing rate measuring device, and the timing rate can be measured in the conventional manner.

In accordance with this invention, either an electromagnetic type or a piezoelectric type device can be adapted to work in an alarm function as the sound generating device. Furthermore, the timing rate can be measured not only by using an electromagnetic field detector but also by using a sound detector.

If all of the segments (not shown) of a display are lit at the time of measuring the timing rate, the timing rate can be readily measured by using an electric field detector because no segment of the display is flickering. If the display is flickering or portions of the display are flickering, the driving signal for making the display flicker is detected along with the 32 Hz modulating signal because flickering of the display is accomplished by periodically reversing one electric potential of the liquid crystal display device. Thus, the electric field detector senses an electric field caused by a 32 Hz signal used for an AC drive which is applied to the electrodes of the liquid crystal display device. Moreover, with this structure, a test whether all of the segments are lit or not can be made. Therefore, all three kinds of detectors which are now in general use can be used at the time of measuring the timing rate of a wristwatch in accordance with this invention when the circuit as shown in FIG. 2 is included. The measuring technique using an electromagnetic field detector, namely the easiest measuring method, is possible because of the 1 Hz signal applied from the sound generating device.

FIG. 2 shows a circuit which has been described above for lighting all of the segments. A decoder circuit 20 converts each output T of the counters 3 into a segment signal necessary for display. An OR gate 22 when driven causes every segment to be illuminated in a segment driving circuit and display device 21. The lead 23 of FIG. 2 is connected to the signal lead 23 of FIG. 1. Because the logical level of the signal 23 becomes high, as stated above, when switches 18, 19 are closed, the logical level of all of the outputs is made high by means of the OR gate 22 regardless of the segment signals for any numeral, which signals are applied from the decoder 20. Thus the signal on lead 23 overrides the signals from the decoder 20. The output signals of the timekeeping counter 3 are fed to the decoder 20. By adding a very simple circuit, the timing rate measurement and testing of whether all the display segments are lit or not are easily performed simultaneously.

Adoption of this invention has a great effect on the post sales servicing of the wristwatch. For a user, it is possible to use the sound which is generated from the sound generating device at the time of measuring the timing rate as one supplemental function, e.g. a pacemaker. The usefulness of the wristwatch as a product is increased by this simple circuit structure.

When this invention is applied to an analog timepiece not having a seconds hand where it normally takes considerable time to measure the timing rate in the conventional manner and where the interval of time between advances of the minute hand is long, rapid measurement of the timing rate is possible. Thus, this invention can also be applied to an analog timepiece.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic wristwatch including an oscillation circuit generating a time standard frequency signal, a divider network dividing down said standard frequency signal and outputting lower frequency signals, timekeeping circuits, display driving circuits, a display, the improvement therein comprising:

an alarm circuit including a sounding device for producing audible signals at a preselected time;

induction coil means, said coil means being a portion of said sounding device, said coil means cooperating with a power source, and being adapted to produce a magnetic field externally of said coil means when current flows therethrough, said magnetic field being detectable externally of said wristwatch;

switch means, the state of said switch means, on or off, controlling current flow through said coil means;

first circuit means for signal generating, said signals being derived from said divider network and applied to said switch means to control said current flow at a first repetition rate to generate a corresponding external magnetic field for timing said wristwatch by magnetic field detection;

an external member, operation of said external member activating said first circuit means for signal generation.

2. An electronic wristwatch as claimed in claim 1, and further comprising second signal generating means, said second signal generating means outputting signals at a selected time to said switch means at a second repetition rate turning said switch means on and off;

said sounding device emitting sound in response to said current passing through said coil means in response to said signals at said second repetition rate, whereby audible sounds are emitted at said selected time to serve as an alarm.

3. An electronic wristwatch including an oscillation circuit generating a time standard frequency signal, a divider network dividing down said standard frequency signal and outputting lower frequency signals, timekeeping circuits, display driving circuits, a display, the improvement therein comprising:

an induction coil, said coil cooperating with a power source, and being adapted to produce a magnetic field when current flows therethrough, said magnetic field being detectable externally of said wristwatch;

switch means, the state of said switch means, on or off, controlling current flow through said coil;

first signal generating means, said signals being applied to said switch means to control said current flow at a first repetition rate to generate a corresponding external magnetic field for timing said wristwatch by magnetic field detection;

an external member, operation of said external member activating said first circuit signal generating means;

second signal generating means, said second signal generating means outputting signals at a selected time to said switch means at a second repetition rate;

and a sounding device, said sounding device emitting sounds in response to said current passing through said coil in response to said signals at said second repetition rate, whereby sounds are emitted at said selected time to serve as an alarm, said signals at said first and second repetition rates being modulated at a frequency substantially higher than said repetition rates, said switch means opening and closing at said higher frequency rate, a readily audible alarm sound being produced at said higher frequency, and said timing signals are both audible and effective in inducing a voltage in an external electromagnetic detector.

4. An electronic wristwatch as claimed in claim 3, wherein said signals at said second repetition rate are delivered only over a portion of each second.

5. An electronic wristwatch as claimed in claim 4, wherein said second repetition rate exceeds said first repetition rate.

6. An electronic wristwatch as claimed in claim 1, 3 or 5, wherein said signals at said first repetition rate have a pulse width not exceeding 1/16 seconds, and a period not exceeding 10 seconds.

7. An electronic wristwatch as claimed in claim 3, or 5, wherein said display is a liquid crystal display.

8. An electronic wristwatch including an oscillation circuit generating a time standard frequency signal, a divider network dividing down said standard frequency signal and outputting lower frequency signals, timekeeping circuits, display driving circuits, a liquid crystal display, the improvement therein comprising:

and induction coil, said coil cooperating with a power source, switch means, the state of said switch means, on or off, controlling current flow through said coil;

first circuit means for signal generating, said signals being applied to said switch means at a first repetition rate for timing said wristwatch;

an external member, operation of said external member activating said first circuit means for signal generation, circuit means for lighting every segment of said liquid crystal display during generation of said signals at said first repetition rate.

9. An electronic wristwatch as claimed in claim 2, wherein said sounding device is a loudspeaker.

10. An electronic wristwatch as claimed in claim 2, wherein said sounding device is a piezoelectric element.

* * * * *